United States Patent [19]

Schröter

[11] 4,248,370

[45] Feb. 3, 1981

[54] EQUIPMENT FOR BREAKING THE SCRAP OR USEFUL PARTS AWAY FROM STAMPED WORKPIECES FROM FLAT MATERIAL

[75] Inventor: Friedrich Schröter, Isernhagen, Fed. Rep. of Germany

[73] Assignee: WUPA Maschinenfabrik GmbH, Fed. Rep. of Germany

[21] Appl. No.: 29,001

[22] Filed: Apr. 11, 1979

[30] Foreign Application Priority Data

Apr. 12, 1978 [DE] Fed. Rep. of Germany ..... 2815797

[51] Int. Cl.[3] ..... B26F 3/00

[52] U.S. Cl. ..... 225/97; 493/82

[58] Field of Search ..... 225/97; 93/36 A; 83/560, 562, 620

[56] References Cited

U.S. PATENT DOCUMENTS

| | | | |
|---|---|---|---|
| 1,897,437 | 2/1933 | Munro | 83/562 |
| 3,055,275 | 9/1962 | Schroter | 225/97 X |
| 3,249,272 | 5/1966 | Scarpa | 225/97 X |
| 3,784,070 | 1/1974 | Vossen | 225/97 X |

*Primary Examiner*—Frank T. Yost

*Attorney, Agent, or Firm*—Lerner, David, Littenberg & Samuel

[57] ABSTRACT

Apparatus is provided for breaking parts away from workpieces which includes a first set of work-engaging fingers arranged on one side of the workpiece and a second set of work-engaging fingers arranged on the other side of the workpiece. Oppositely-disposed first and second support structures for the first and second sets of work-engaging fingers are provided. Each of the support structures include a guide rail having guiding grooves formed therein, first and second clamping means each mounted to engage and move relative to the guiding grooves so that the first and second clamping means can be moved passed each other without interference, and first and second holding means are provided which are movably connected to the first and second clamping means, respectively, for supporting each set of work-engaging fingers.

11 Claims, 3 Drawing Figures

EQUIPMENT FOR BREAKING THE SCRAP OR USEFUL PARTS AWAY FROM STAMPED WORKPIECES FROM FLAT MATERIAL

The invention relates to equipment for breaking the scrap or the useful parts from stamped workpieces from flat material, comprising a first set of break-away fingers arranged on one workpiece side and a second set of break-away fingers arranged on the other workpiece side and displaceable towards the first set; as well as guide rails associated with the two sets and on which the break-away fingers carried by holders can be secured in position by clamp bolts through pairs of clamping jaws together with the holders which are in contact with but displaceable relative to said clamping jaws.

In known equipment of this kind (German patent specification No. 1,149,976) the guide rail has at the opposite head faces guide pieces which are embraced by the clamping jaws. The holders have a threaded bore which serves as a nut for the clamping bolt. In this way the holder forms, together with the clamping jaws and the clamping bolt, a unit which can be restrained on the rail. When the clamping bolt is loosened, the holder can certainly be swung horizontally about the clamping bolt so that, taking into consideration the displaceability of the entire unit on the rail, any point on the flat material can be reached, but the possibility of arranging the break-away fingers in a confined space is restricted.

If, that is to say, a number of break-away fingers were required in a confined space, two adjacent guide rails would have to be brought together. Since, however, the guide rails cannot be brought as closely together as might be desired, limits are set to the arrangement of the break-away fingers in a confined space. Moreover, the setting of the break-away fingers turns out to be complicated because the setting of the individual break-away fingers must take place in the order of their arrangement on the rail.

The object of the invention is to provide equipment for breaking the scrap or useful parts away from stamped workpieces from flat material, which is improved in that greater freedom is available in the arranging of the break-away fingers and in that the adjustability is facilitated.

In accordance with the invention, this object is achieved with equipment of the kind referred to initially, in that the guide rails have V-shaped guide grooves in their head faces, and in that the holders with associated clamping jaws are arranged on each side of the guide rail and engage in the guide grooves, the clamping jaws arranged on the same side of the guide rail allowing the clamping jaws arranged on the other side of the same guide rail sufficient free space to let one another pass when they are moved along the guide rail.

As compared with the known equipment, the equipment according to the invention with the same number of break-away fingers involves a less complicated technical structure since less guide rails are required. This arrangement also enables the break-away fingers to be positioned much more closely than hitherto upon the flat material. Nor is it any longer necessary, when positioning, to take into consideration as strictly as hitherto the order of sequence of the fingers with their holders and clamping jaws on the clamping rail, since the individual units may be moved past one another.

An embodiment of the invention will now be described in more detail with reference to the accompanying drawings, in which.

Figure 1:
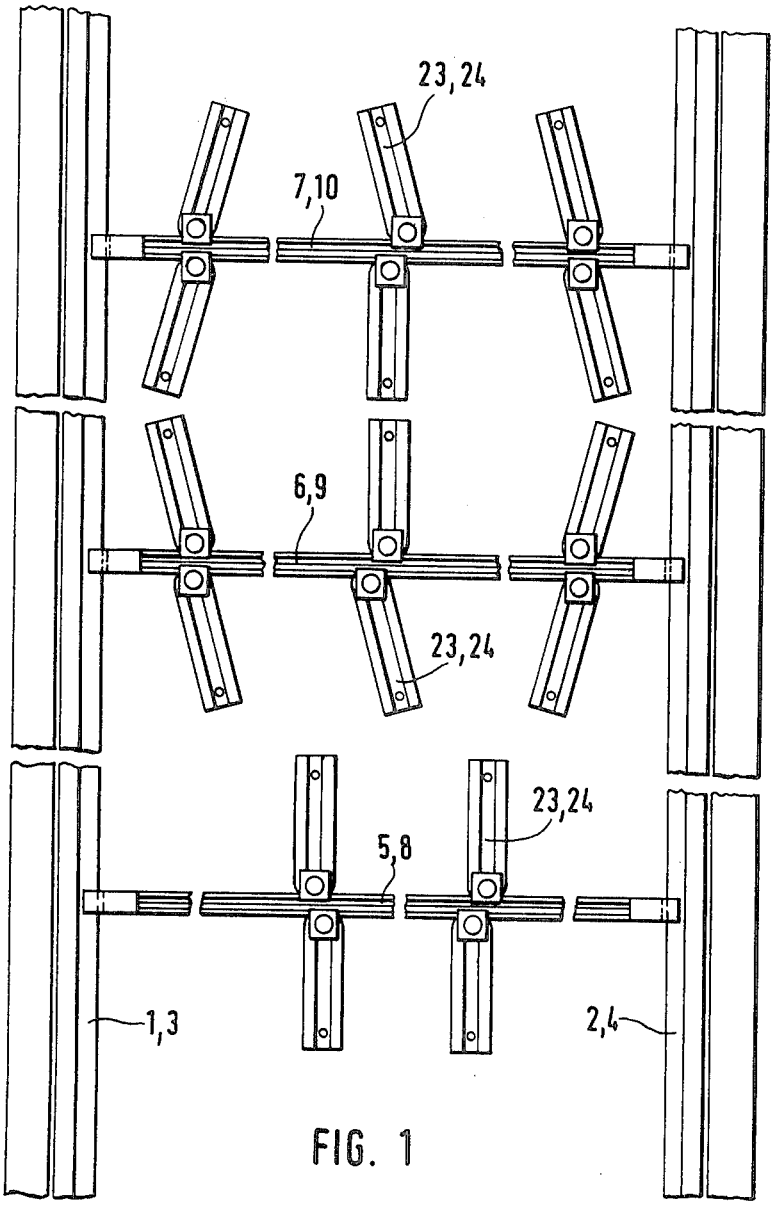
FIG. 1 is a plan view of the equipment for breaking the scrap or useful parts away from stamped workpieces of flat material.

The equipment according to the invention comprises two upper longitudinal rails 1 and 2 and two lower longitudinal rails 3 and 4, on which upper and lower guide rails 5 to 10 are slidably mounted. The guide rails 5 to 10 can be clamped to the longitudinal rails 1 to 4 by clamping means (not illustrated). Either the upper set of rails 1, 2, 5 to 7, or the lower set of rails 3, 4, 8 to 10, is held in a control mechanism (not illustrated) by means of which it can be moved towards the other set of rails. The guide rails 5 to 10 carry several gripper units with upper and lower break-away fingers 21 and 22, the upper fingers being screwed into holders 23, whilst the lower ones are resiliently supported in holders 24, in the manner known from German patent specification No. 1,149,976. The fingers 21 and 22 are aligned with each other and form a pair in each case.

Figure 2:
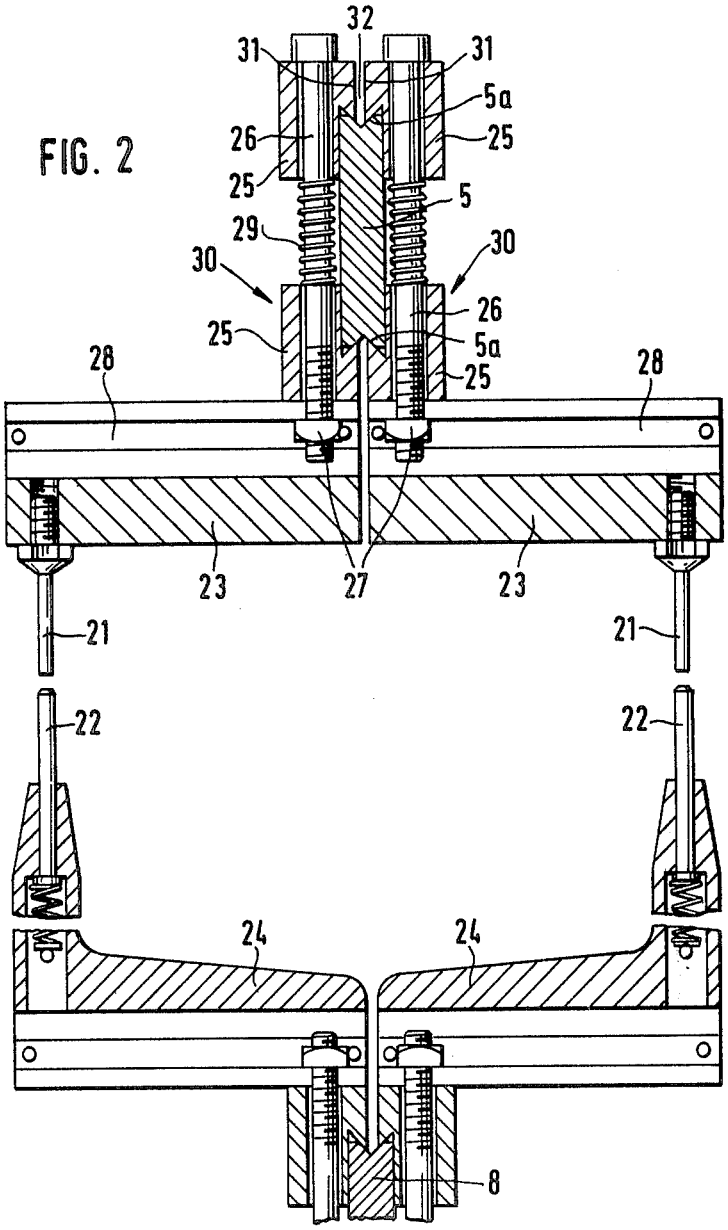
FIG. 2 shows in cross section two oppositely-situated guide rails with oppositely-arrange clamping units, in section.

The construction of the gripper units with break-away fingers 21 and 22 is illustrated in FIG. 2, showing units which are superposed and opposed. Each of the two head faces of the rail 5 has a V-shaped guide groove 5*a* therein. A clamping device 30 is mounted with two clamping jaws 25, each bearing against the respective flank of each of the upper and lower V-shaped guide grooves 5*a*. The two clamping jaws 25 are held together by a threaded bolt 26. The threaded bolt 26 engages with its end, on which a nut 27 in the form of a sliding block is fitted, in a T-shaped groove 28 in the holder 23 or 24. On the screw bolt 26 between the clamping jaws 25 is fitted a helical spring 29 which, when the bolt is loosened, also keeps the holder 23 or 24 in the position which it had occupied before the bolt was loosened. The clamping jaws 25 are so formed that their pitched faces 31, directed towards the centre line of the guide groove 5*a* and parallel to the guide rail 5, do not come up to the centre of the guide groove 5*a*, so that a gap 32 remains between the pairs of clamping jaws 25 which are oppositely situated upon the guide rail 5.

Figure 3:
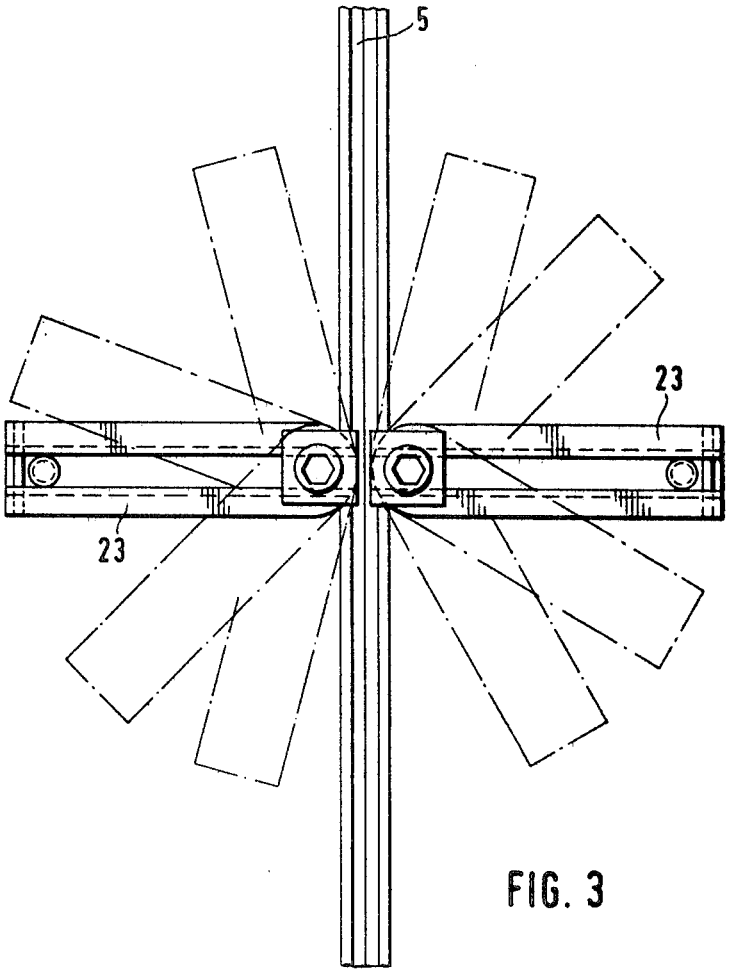
FIG. 3 is a plan view of a guide rail, showing the various possible positions of two oppositely-arranged clamping units.

Thus, the gripper units can be arranged opposite each other and, when the bolt 26 is loosened, can be moved beyond one another on setting up. By displacing the clamping jaws 25 on the guide rail 5 and displacing the holder 23 or 24 in the groove 28, as well as by swivelling the holder 23 or 24, any desired position of the break-away fingers 21 and 22 may be obtained when the rail 5 is densely occupied with clamping jaws 25 and holders 23 and 24. A further range of adjustment is available as the break-away fingers 21 and 22 can be swung horizontally with their holders 23 and 24, as shown in FIG. 3.

I claim:

1. Apparatus for breaking away parts from workpieces, comprising a first set of work-engaging fingers to be disposed on one side of a workpiece, a second set of work-engaging fingers to be disposed on an opposite side of the workpiece and oppositely disposed first and second supporting means for movably supporting said first and second sets of work-engaging fingers, respectively, at least one of said first and second supporting means including a guide rail having first and second guiding grooves formed in upper and lower surfaces, respectively, thereof, first and second clamping means mounted on opposite sides of said guide rail, each clamping means including first and second clamping jaws, each of said first and second clamping jaws being mounted to engage and move relative to said first and second guiding grooves, respectively, such that said first and second clamping means can be moved past each other on said guide rail, and first and second holding means connected to said first and second clamping means, respectively, each holding means holding at least one work-engaging finger of one of said first and second sets of work-engaging fingers.

2. Apparatus in accordance with claim 1, wherein said first and second clamping means are spaced apart relative to each other in said first and second guiding grooves so that said first and second clamping means can be moved past each other without interference.

3. Apparatus in accordance with claim 1, wherein said first and second clamping jaws are adjustably connected to each other for movement relative to said first and second guiding grooves.

4. Apparatus for breaking away parts of workpieces, comprising a first set of work-engaging fingers to be disposed on one side of a workpiece, a second set of work-engaging fingers to be disposed on an opposite side of the workpiece and oppositely disposed first and second supporting means for movably supporting said first and second sets of work-engaging fingers, respectively, at least one of said first and second supporting means including a guide rail having at least one guiding groove formed therein, first and second clamping means mounted on opposite sides of said guide rail, each clamping means being mounted to engage and move relative to said at least one guiding groove such that said first and second clamping means can be moved past each other on said guide rail, and first and second holding means slidably mounted on said first and second clamping means, respectively, each holding means holding at least one work-engaging finger of one of said first and second sets of work-engaging fingers.

5. An apparatus in accordance with claim 4, wherein said first and second clamping means include first and second connecting means, respectively, said first connecting means connecting said first clamping means to said first holding means and said second connecting means connecting said second clamping means to said second holding means, and wherein said first and second holding means include first and second receiving means, respectively, said first connecting means being slidably received in said first receiving means, whereby said first holding means is slidably movable relative to said first clamping means, and said second connecting means being slidably received in said second receiving means, whereby said second holding means is slidably movable relative to said second clamping means.

6. Apparatus in accordance with claim 4, wherein said first and second clamping means are spaced apart relative to each other in said at least one guiding groove so that they can be moved passed each other without interference.

7. Apparatus in accordance with claim 1 or 4, wherein the other of said first and second supporting means includes the same structure as said at least one of said first and second supporting means.

8. Apparatus for breaking away parts from workpieces, comprising a first set of work-engaging fingers to be disposed on one side of a workpiece, a second set of work-engaging fingers to be disposed on an opposite side of the workpiece and oppositely disposed first and second supporting means for movably supporting said first and second sets of work-engaging fingers, respectively, each of said first and second supporting means including a guide rail having at least one substantially V-shaped guiding groove formed therein, first and second clamping means mounted on opposite sides of said guide rail, each clamping means being mounted to engage and slidably move relative to said at least one substantially V-shaped guiding groove such that said first and second clamping means can be moved past each other on said guide rail, and first and second holding means connected to said first and second clamping means, respectively, each holding means holding at least one work-engaging finger of one of said first and second sets of work-engaging fingers.

9. Apparatus in accordance with claim 8, wherein said first and second clamping means are spaced apart relative to each other on said at least one substantially V-shaped guiding groove so that they can be moved past each other without interference.

10. Apparatus in accordance withs claim 1, 4 or 8, wherein said first and second holding means are pivotally mounted relative to said first and second clamping means, respectively.

11. Apparatus for breaking away parts from workpieces, comprising a first set of work-engaging fingers to be disposed on one side of a workpiece, a second set of work-engaging fingers to be disposed on an opposite side of the workpiece and oppositely disposed first and second supporting means for movably supporting said first and second sets of work-engaging fingers, respectively, each of said first and second supporting means including a guide rail having first and second substantially V-shaped guiding grooves formed in upper and lower surfaces, respectively, thereof, first and second clamping means mounted on opposite sides of said guide rail and spaced apart relative to each other in said first and second substantially V-shaped guiding grooves so that said first and second clamping means can be moved past each other on said guide rail without interference, each clamping means including first and second clamping jaws, each of said first and second clamping jaws being mounted to engage and move relative to said first and second substantially V-shaped guiding grooves, respectively, and being adjustably connected to the other of said first and second clamping jaws for movement relative to said first and second substantially V-shaped guiding grooves, and first and second holding means connected to said first and second clamping means, respectively, each holding means holding at least one work-engaging finger of one of said first and second sets of work-engaging fingers.

* * * * *